United States Patent [19]

Henson

[11] 4,129,151

[45] Dec. 12, 1978

[54] CAP FOR RELEASABLY COVERING WELL CASINGS

[76] Inventor: F. Gene Henson, 806 SE. 8th St., Grants Pass, Oreg. 97526

[21] Appl. No.: 900,471

[22] Filed: Apr. 27, 1978

[51] Int. Cl.[2] ..... F16L 55/10

[52] U.S. Cl. ..... 138/89; 220/320

[58] Field of Search ..... 220/320, 321; 138/89, 138/96; 292/256.65

[56] References Cited

U.S. PATENT DOCUMENTS

| | | | |
|---|---|---|---|
| 2,714,469 | 8/1955 | Carlson | 220/320 |
| 2,735,697 | 2/1956 | Zanin | 138/89 X |
| 3,631,895 | 1/1972 | Medina | 138/89 |

*Primary Examiner*—George T. Hall

*Attorney, Agent, or Firm*—Chernoff & Vilhauer

[57] ABSTRACT

A cap for covering a cylindrical tubular well casing is comprised of a thin planar circular cross-sectioned cover plate which has a diameter slightly larger than the outside diameter of the casing so as to form an overhanging lip thereon. An expandable clamp ring, which secures the cover plate to the casing, includes a semicylindrical outer band, which has a nominal diameter equal to the diameter of the cover plate, and an inwardly extending upper rim, which is joined normally to the top edge of the outer band and overlies the upper surface of the overhanging lip of the cover plate. A gasket, which is attached to the outer band immediately below the lip of the cover plate, is arranged to be tightly compressed between the band and the casing when the ends of the clamp ring are urged together by an adjustable fastener. Tabs extend downwardly from the lower surface of the cover plate to ensure its being centered on the casing during installation, a threaded boss passes through the cover plate for attachment to an outlet pipe and a pump pipe, and bores which extend through the cover plate pass electrical wires for operation of the pump.

5 Claims, 4 Drawing Figures

CAP FOR RELEASABLY COVERING WELL CASINGS

BACKGROUND OF THE INVENTION

This invention relates to a cap for well casings, and particularly to a cap which is quickly and easily secured to the well casing and is centered thereon.

When wells, such as for obtaining water, are drilled, cylindrical tubing in the form of steel pipe is inserted into the resulting well shaft to serve as the side walls of the well. Typically a short portion of this casing extends out of the ground as the upper terminal of the well, which must be covered to prevent foreign matter from entering the well. In addition the cover provides provisions for passing tubing to the pump, which is submerged in the well. Accordingly, the cover must be easily removed so that the pump can be replaced or repaired when necessary, and the cover must be generally centered on the casing in order to center the pump in the well.

Heretofore releasable covers, such as those shown in Baker, et al U.S. Pat. No. 3,473,537, Medina, U.S. Pat. No. 3,631,895 and Martin, U.S. Pat. No. 3,963,054 have been provided for this purpose. However, all of the prior art covers of this class heretofore available have sophisticated clamping and centering means, which are prohibitively expensive for use in a single family water well. In addition the complexity of these devices greatly adds to the difficulty in installing and removing the cover, and results in a high rate of failure when the cover is repeatedly removed and installed.

SUMMARY OF THE INVENTION

The cap of the present invention comprises a thin planar circular cross-sectioned cover plate which has a diameter slightly larger than the outside diameter of the well casing, so as to provide an overhanging lip which extends outwardly beyond the well casing. An expandable clamp ring has a semicylindrical outer band, which nominally has the same diameter as the cover plate, and an upper lip which extends inwardly from the upper edge of the outer band to overlie the top of the cover plate. A rectangularly cross-sectioned compressible gasket is attached to the outer band immediately below the cover plate so that the lip of the cover plate is sandwiched between the gasket and the rim of the clamp ring. Accordingly, as the ends of the clamp ring are urged together the gasket is compressed between the outer band of the clamp ring and the casing thereby rigidly fixing the clamp ring, and thus the cover plate to the casing. To this end an adjustable fastener is attached to the respective ends of the clamp ring in order to allow its ends to be pulled together.

The cover plate is centered on the casing during installation by means of downwardly facing tabs which are attached to its bottom surface and a central threaded boss passes through the cover plate for attachment to an outlet pipe on one end and a pump interconnection pipe on the other end. Also openings pass through the cover plate for insertion of electrical wiring for operation of the pump.

Accordingly, it is a principal object of the present invention to provide a cap for well casings which is quickly and easily installed and removed.

It is a further object of the present invention to provide such a cover plate which is easily centered upon installation and remains centered when it is secured to the casing.

It is a further object of the present invention to provide such a cap which is of simplified design for low cost manufacture and maintenance free use.

The foregoing objectives, features and advantages of the present invention will be more readily understood upon consideration of the following detailed description of the invention taken in conjunction with the accompanying drawings.

DETAILED DESCRIPTION OF THE INVENTION

Figure 4:
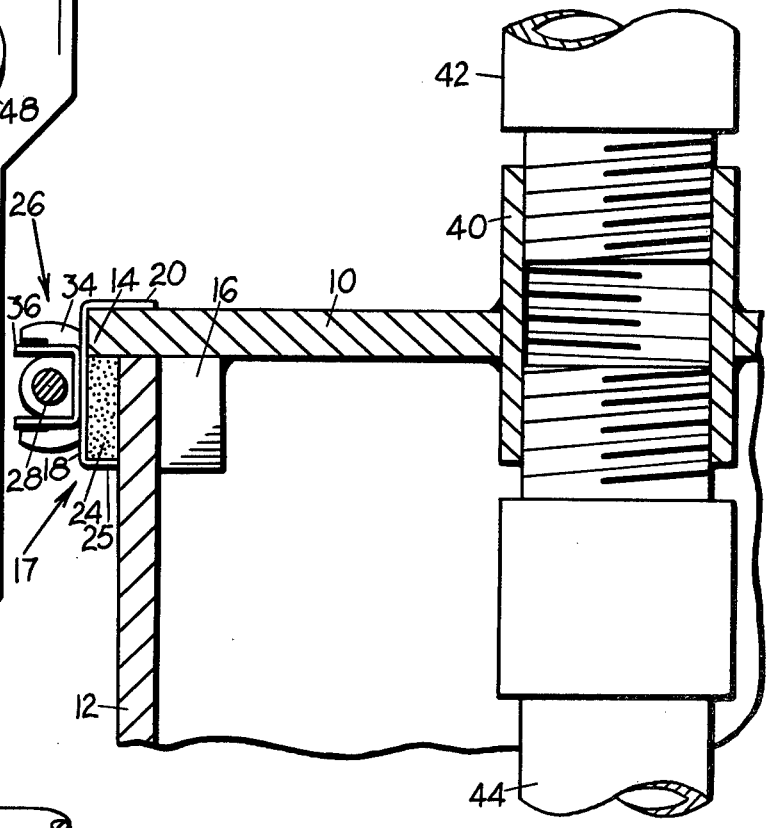
FIG. 4 is a fragmentary sectional view, at an enlarged scale, taken along the line 4—4 in FIG. 2.

Referring to the drawings, the well cap of the present invention includes a thin circular cover plate 10 which is configured to fit atop a cylindrical tubular well casing 12. In a typical well, the major extent of the casing is located below ground to form the sides of the well, and only the short portion shown in the drawings is exposed. The cover plate has a diameter which is greater than the outside diameter of the casing so as to provide an overhanging lip 14, best shown in FIG. 4. The exact amount which lip 14 overhangs the casing is critical to the operation of the well cap as will be more fully explained later.

An internally threaded tubular boss 40 passes centrally through the cover plate, and is attached to it by means such as welding, for connection to an inlet pipe 42 and a pump interconnection pipe 44. Accordingly, when the cover plate is installed on the casing the pump (not shown) which is attached to pipe 44 is supported by the cover plate and is centered in the well. Also, paired threaded bores 48 pass through the cover plate on opposite sides of boss 40. In the embodiment illustrated one of the bores is covered with a cap 50 and the other mounts appropriate junction boxes for passage of electrical wiring (not shown) for operation of the pump. However, with certain types of pumps wiring will pass through both of the bores.

Located on the lower surface of cover plate 10 are two or more downwardly extending locating tabs 16 which are centered at an effective diameter which is slightly less than the inside diameter of the casing. Thus when the cover plate is placed on the casing it is centered so that the lip overhangs an equal amount around its entire periphery. Tabs 16 also serve to stiffen the cover plate and thereby prevent it from becoming warped.

Figure 3:
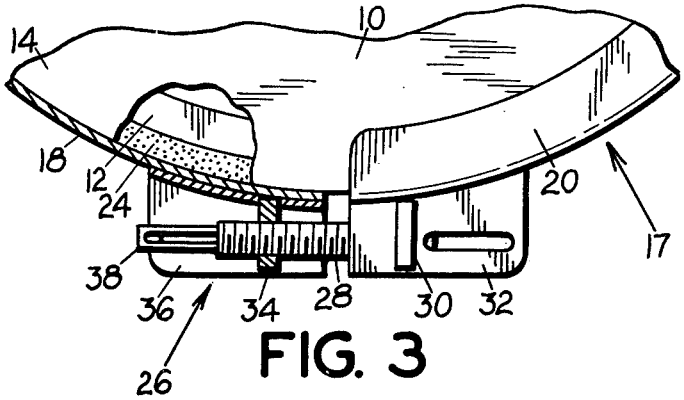
FIG. 3 is a fragmentary cross-sectional view, at an enlarged scale, taken along the line 3—3 in FIG. 2.

The cover plate is attached to the casing by means of an expandable clamp ring 17 having an outer band 18 which has a diameter nominally equal to the diameter of the cover plate and having a length which is less than the circumference of the cover plate, so that its ends are separated when the band encircles the cover plate. Located at the upper edge of band 18 is an inwardly extending upper rim 20, which is arranged so that when band 18 is placed against the edge of cover plate 10, rim 20 overlies lip 14, FIGS. 3 and 4.

Attached to the lower portion of the inner surface of band 18 is a compressible rectangularly cross-sectioned gasket 24 which is located below upper rim 20 by a distance which is approximately equal to the thickness of cover plate 10. Thus lip 14 is sandwiched between the rim of the clamp and the gasket. The gasket has a thickness which normally is greater than the overhang of lip 14 but which is substantially equal to the overhang when compressed. A lower ring 25, having a length which is slightly less than the thickness of the gasket, when it is compressed, extends inwardly from the lower edge of band 18 immediately below the gasket to provide support on its lower edge.

The clamping ring secures the cover plate to the well casing by tightening of fastener means 26 which are associated with the ends of the clamp ring and which urge the ends together when it is tightened. In the embodiment illustrated the fastener means comprises a threaded rod 28 which is rotatably joined to one end of band 18 by means of a pillow block 30, carried between paired tabs 32. A threaded boss 34 is attached to the other end of band 18 by means of paired tabs 36. A gripping portion 38 is provided on the terminal end of threaded rod 28 to aid in its insertion into boss 34 and thereafter for twisting it.

Figure 1:
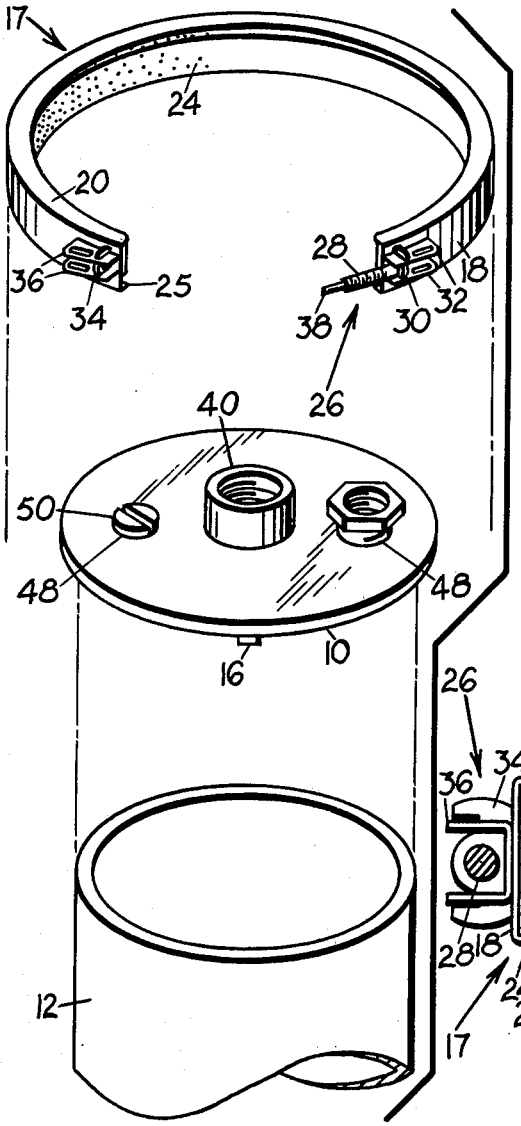
FIG. 1 is an exploded perspective view showing a preferred embodiment of the well cap of the present invention.

Before cover plate 10 is placed on casing 12, a pump interconnection pipe 44 of the proper length is attached to the pump and to boss 40. The cover plate is then placed on top of casing 12 with the pump suspended below it. It will be noted that tabs 16 center the cover plate on the casing so that lip 14 overhangs the edge of the casing by approximately an equal amount around its periphery. Clamp ring 17 is expanded to the shape shown in FIG. 1, placed over the cover plate and its ends pulled together so that lip 14 is received in the opening between rim 20 and gasket 24, and the terminal portion 38 of threaded rod 28 is inserted through threaded boss 34.

Figure 2:
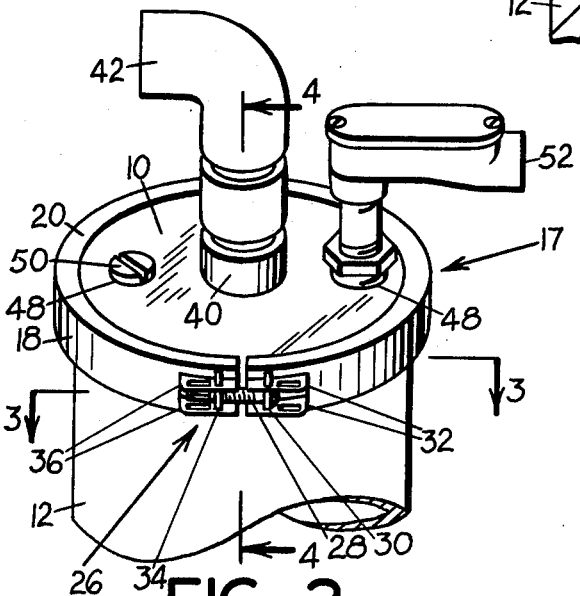
FIG. 2 is a perspective view showing the well cap installed on a typical well casing.

The threaded rod is then engaged in the boss and rotated until the clamp ring is pulled to the tightened position shown in FIG. 2. When in this position, gasket 24 is compressed between band 18 and casing 12 so that the clamp ring is securely clamped to the casing. As a result, since upper rim 20 of the clamp ring overlies the cover plate, the cover plate also is secured to the casing. Furthermore, due to the orientation of the elements, the cover plate necessarily is centered on the casing thereby centering the pump therein. It will also be noted that since gasket 24 extends vertically between lip 14 and lower ring 25, as it is compressed laterally it spreads somewhat vertically so as to form a seal with the bottom of the lip. Accordingly, the cover plate becomes completely sealed with the casing and can be used for capping artesian wells.

The cover plate is removed by reversing the above-described procedure. Accordingly, the cover plate can be quickly and easily installed and removed so that it is centered on the casing.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A cap for covering the open top of a tubular cylindrical well casing and for supporting a submersible pump, comprising:

(a) a thin planar circular cross-sectioned cover plate having a diameter which is slightly greater than the outside diameter of said well casing so as to form an overhanging lip;

(b) an expandable, semicircular clamp ring having a nominal diameter which is substantially equal to the diameter of said cover plate;

(c) said clamp ring having an inwardly extending upper rim which is arranged to fit over said lip of said cover plate;

(d) a compressible annular gasket having a thickness which is greater than the depth of said overhanging lip;

(e) said gasket being attached to said clamp ring a spaced distance below said upper rim in a manner to snugly receive said overhanging lip therebetween; and (f) fastener means asssociated with the respective ends of said clamp ring for urging said ends together upon tightening of said fastener means so as to squeeze said gasket between said clamp ring and said well casing.

2. The cap of claim 1 wherein said fastener means comprises:

(a) a threaded rod;

(b) means for rotatably mounting said threaded rod to said clamp ring at one of the ends thereof;

(c) a threaded boss arranged to receive said threaded rod; and (d) means for mounting said threaded boss on said clamp ring at the other end thereof.

3. The cap of claim 1 including at least two downwardly extending tab means attached to said cover plate at an effective diameter which is less than the inside diameter of said well casing for centering said cover plate on said well casing.

4. The cap of claim 1 including a tubular boss mounted centerally on said cover plate and passing therethrough, said boss including means for releasable interconnection to piping extending both upwardly and downwardly from said cover plate.

5. The cap of claim 1 including means for passing electrical lines through said cover plate.

* * * * *